US005555602A

United States Patent [19]

Leamond

[11] Patent Number: 5,555,602

[45] Date of Patent: Sep. 17, 1996

[54] ERASER ASSEMBLY

[76] Inventor: William T. Leamond, 1727 Wambaw Ave., Charleston, S.C. 29412

[21] Appl. No.: 355,628

[22] Filed: Dec. 14, 1994

[51] Int. Cl.[6] ..... B43K 29/02

[52] U.S. Cl. ..... 15/428; 15/443; 401/88; 401/91

[58] Field of Search ..... 15/424–434; 401/88, 401/91

[56] References Cited

U.S. PATENT DOCUMENTS

| | | | |
|---|---|---|---|
| 78,158 | 5/1868 | Toof | 15/428 |
| 606,551 | 6/1898 | Huffman | 15/428 |
| 833,744 | 10/1906 | Koehler | 401/91 |
| 948,822 | 2/1910 | McSweeney et al. | 15/428 |
| 1,121,318 | 12/1914 | Allen | 15/428 |
| 1,224,992 | 5/1917 | Ziemer | 15/427 |
| 1,257,383 | 2/1918 | Olson | 15/427 |
| 1,273,697 | 7/1918 | Vidal | 401/88 |
| 1,339,707 | 5/1920 | Lazarides | 15/428 |
| 1,473,090 | 11/1923 | Ferry . | |
| 1,550,770 | 8/1925 | Akira | 15/428 |
| 1,569,742 | 1/1926 | Goerling | 15/428 |
| 1,671,393 | 5/1928 | Zantow . | |
| 1,976,667 | 10/1934 | Henwood | 15/431 |
| 2,747,548 | 5/1956 | Platzke | 15/428 |
| 3,072,101 | 1/1963 | Kovacs . | |
| 3,099,251 | 7/1963 | Hertz . | |
| 3,846,866 | 11/1974 | Burnett . | |
| 3,945,733 | 3/1976 | Edel . | |
| 4,167,347 | 9/1979 | Hoyle . | |
| 4,352,580 | 10/1982 | Ando . | |
| 4,884,910 | 12/1989 | Kageyama et al. . | |
| 4,899,419 | 2/1990 | Saleen . | |
| 4,932,800 | 6/1990 | Lin et al. . | |
| 5,018,891 | 5/1991 | Kageyama et al. . | |
| 5,056,945 | 10/1991 | Klodt . | |
| 5,072,483 | 12/1991 | Durand . | |
| 5,127,130 | 7/1992 | Copito . | |

FOREIGN PATENT DOCUMENTS

| | | | |
|---|---|---|---|
| 1337623 | 8/1963 | France | 15/428 |
| 332969 | 12/1935 | Italy | 15/428 |
| 6383 | 4/1888 | United Kingdom | 15/428 |

*Primary Examiner*—David Scherbel
*Assistant Examiner*—Randall E. Chin
*Attorney, Agent, or Firm*—Dority & Manning

[57] ABSTRACT

An eraser device has an elongated cylindrical finger grip section with an internal bore defined therethrough. An internal conical bore section is aligned with the internal bore so that the device can be slid or fitted onto the writing end of a writing instrument. At least one eraser arm extends radially outward from the finger grip section and angled forward towards the front end of the device. An eraser is configured at the end of the eraser arm so that an operator can use the eraser by merely tilting and rotating the finger grip section to bring the eraser arm and eraser into contact with a writing surface.

14 Claims, 3 Drawing Sheets

ERASER ASSEMBLY

BACKGROUND OF THE INVENTION

The present invention relates to an eraser assembly for any manner of writing instrument, and particularly to an eraser device for attachment to the writing end portion of a writing instrument which includes a branching or furcated eraser.

Both mechanical and conventional writing instruments, such as pencils, pens, etc., for many years have been adapted to provide an attached eraser generally at the end of the cylindrical pencil barrel opposite from the writing end of the instrument. For example, conventional wood pencils typically are provided with a non-removable and non-adjustable eraser attached by means of a cylindrical metal band and sized such that the exhaustion of the usable portion of the eraser hopefully coincides with the life of the pencil as it is used and resharpened.

Mechanical pencils, on the other hand, have a virtually unlimited life by virtue of replacement pencil leads. As a result, mechanical pencils are sometimes provided with an adjustable eraser mechanism and replacement erasers disposed at the non-writing end of the instrument. Examples of these eraser mechanisms can be found, for example, in U.S. Pat. Nos. 1,671,393; 3,072,101; 3,099,251; and 4,352,580. Each of the listed U.S. Patents provides a unique type of adjustment mechanism to facilitate extension of additional portions of an eraser at the non-writing end as the eraser is consumed during normal use.

U.S. Pat. No. 1,473,090 to Ferry discloses a eraser assembly which is mounted to the outside of a lead pencil generally at the writing end of the pencil. The assembly is configured to be pushed forward to bring an attached eraser in close proximity to the lead point. Sliding of the assembly forward places the eraser segment at a point beyond the writing tip of the pencil. This eraser assembly suffers a significant disadvantage in that the assembly at the writing end unbalances the pencil, obscures the point of the pencil and written material, is subject to relatively easy loss or misplacement, and presents an unnecessary obstruction to finger placement on the writing instrument.

U.S. Pat. No. 4,899,419 to Saleen discloses a sleeved eraser assembly similar to that disclosed in U.S. Pat. No. 1,473,090, but is intended for use with a mechanical pencil. This assembly suffers the same disadvantages noted above with the '090 patent.

None of the above-listed references provide maximum convenience to the user of a conventional or mechanical pen or pencil and have not succeeded in making the application of the eraser almost as easy and convenient as the application of the writing point of the instrument.

OBJECTS AND SUMMARY OF THE INVENTION

It is therefore a principal object of the present invention to provide an eraser device for use with any manner of writing instrument which provides maximum convenience and reliability to a user.

It is a further object of the present invention to provide an eraser assembly that does not adversely affect application of the writing point of the writing instrument.

And yet another object of the present invention is to provide an eraser device for use with any manner of writing instrument wherein the instrument does not have to be flipped in order to apply the eraser.

And yet another object of the present invention is to provide an eraser assembly for use at the writing end of a writing instrument having removable eraser inserts thereby providing the eraser assembly with a virtually infinite life.

Additional objects and advantages of the invention will be set forth in part in the following description, or may be obvious from the description, or may be learned through practice of the invention.

In accordance with the objects of the invention, the present invention includes an eraser device for use with a writing instrument, such as a pen, pencil, or mechanical writing instrument. In a preferred embodiment of the device, an elongated essentially cylindrical finger grip section is provided. This grip section includes an internal bore for receipt of a writing instrument therethrough. An internal conical bore section is aligned with the finger grip section internal bore. This conical bore section is tapered towards the front end of the device so as to contact at least a portion of a conical writing tip or point of a writing instrument inserted through the device. In this manner, the writing tip of the instrument extends from the front end of the eraser assembly. At least one eraser arm extends radially outward from the finger grip section and is angled forward towards the front end of the eraser device. An eraser is configured at the end of the eraser arm. In this manner, when the device is configured with a writing instrument, an operator can use the eraser simply by lifting and rotating the finger grip section to bring the eraser arm and eraser into contact with the writing surface.

In a preferred embodiment, at least one internal rib is formed in the finger grip section internal bore so as to non-rotatably lock the writing instrument within the finger grip section. Also, the finger grip section may preferably comprise a textured outer circumferential surface to enhance gripping of the device.

And in still another preferred embodiment of the invention, the eraser is formed integral with the eraser arm. In an alternative embodiment the eraser may comprise a removable insert fitted into the eraser arm.

Preferably, the device is configured to be removable from a writing instrument. In this manner, the device may be used with any number of different writing instruments. Alternatively, the device may be configured to be permanently fixed to the writing instrument.

And in still a further preferred embodiment, the eraser assembly or device is configured for use with a mechanical writing instrument, such as a mechanical lead pencil. In this embodiment, the eraser assembly may include an engaging device, such as a threaded extension member, for engaging or mating with the mechanical writing instrument. For example, the device may comprise a tip to replace conventional tips of standard mechanical lead pencils. The device can also be formed as an integral part of the mechanical pencil. This tip would include the eraser arm and attached eraser extending radially outward and forward therefrom. Preferably, this embodiment also includes removable eraser inserts fitted into the eraser arm.

The eraser assembly or device includes at least one eraser arm with attached eraser, and preferably two such arms disposed radially opposite each other.

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
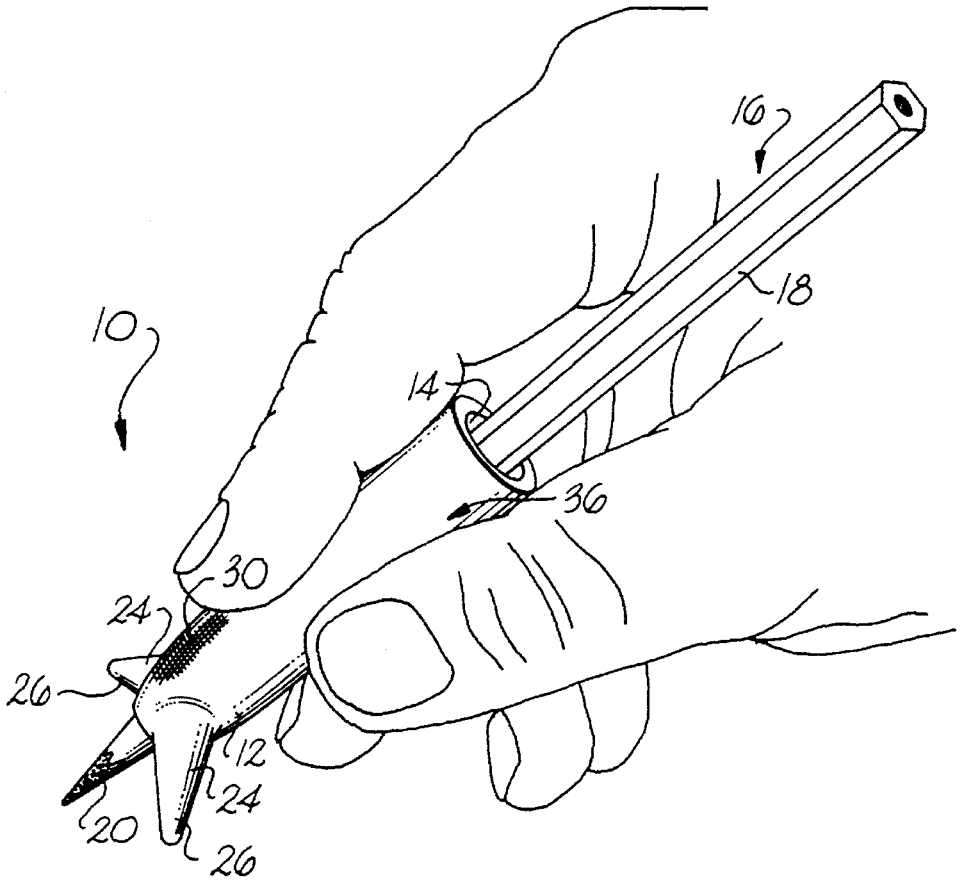
FIG. 1 is a perspective view of an embodiment of the invention in use.

Reference will now be made in detail to the presently preferred embodiments of the invention, one or more examples of which are illustrated in the drawings. Each example is provided by way of explanation of the invention and not as a limitation of the invention. For example, features illustrated or described as part of one embodiment may be used on another embodiment to yield still a further embodiment. It is within the scope of the present invention to cover such various embodiments. Additionally, the numbering of components throughout the drawings and description is consistent, with the same components having the same number throughout.

Referring particularly to FIGS. 1 through 4, the present invention comprises an eraser device generally indicated as 10. Device 10 is configured for use with any manner of writing instrument 16, such as a conventional pencil, pen, or mechanical pencil or pen. It should be understood that the present invention is not limited to any particular type of writing instrument 16. For sake of clarity and ease of explanation, the figures generally depict device 10 configured with a conventional wood/lead pencil.

Device 10 includes a body portion generally indicated as 36. Body portion 36 includes an elongated essentially cylindrical finger grip section 12. Section 12 preferably has a length sufficient for a person to easily grasp device 10 once the device has been fitted or otherwise attached at the writing end of instrument 16, as particularly illustrated in FIG. 1. Preferably, finger grip section 12 also comprises an outer textured circumferential surface 30, as generally indicated in FIG. 1. Textured surface 30 enhances the grip of a person utilizing the device.

An internal bore 14 is defined through body portion 36. Internal bore 14 has a diameter generally sized to match conventional pens, pencils, or other writing instruments for which the device is meant to be configured with. Internal bore 14 extends longitudinally through the device and, in the embodiments illustrated in FIGS. 1 through 4, tapers into a conical bore 22. Conical bore 22 has a taper which is meant to generally match the tapered conical tip 23 of a standard writing instrument 16. Accordingly, it should be understood that the relative dimensions and degree of taper of bore 14 and 22 respectively depends on the writing instrument 16 for which the device is intended.

Internal conical bore section 22 is aligned with finger grip section internal bore 14 so that device 10 can be easily slid onto a barrel 18 of writing instrument 16. The position or location of device 10 on writing instrument 16 is dictated by conical bore 22. For example, device 10 may be slid onto the barrel section 18 of instrument 16 until the conical surface of conical writing tip 23 engages or contacts the conical surface of bore 22. Writing tip 20 of the writing instrument extends through an aperture or hole 19 defined in a front end of device 10.

Device 10 further includes at least one eraser arm 24 which extends radially outward from finger grip section 12 and is angled forward towards the front end of the device. Preferably, device 10 includes at least two eraser arms 24 extending radially opposite from each other. Arms 24 are angled forward preferably within a range of thirty to seventy degrees with respect to the longitudinal centerline of device 10. In a preferred embodiment, arms 24 are formed integral with body portion 36, and may comprise the same material as body portion 36. However, arms 24 must be resilient enough so as not to bend excessively when the device is utilized.

Figure 5:
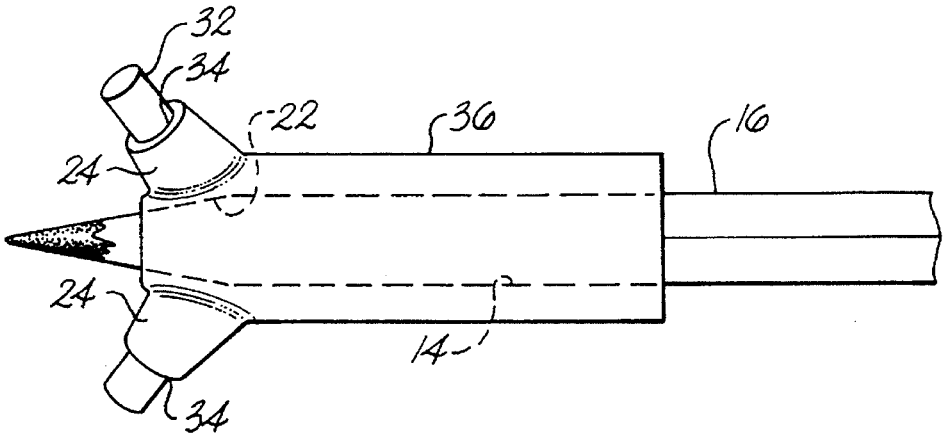
FIG. 5 is a side component view of an alternative embodiment of the invention particularly illustrating eraser inserts.
Figure 6:
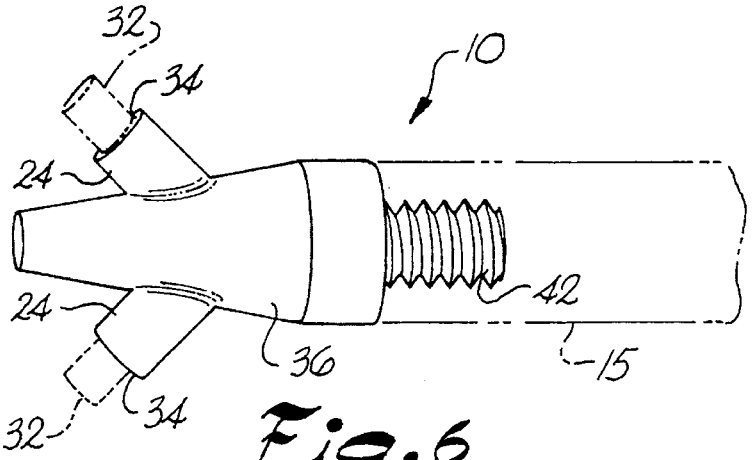
FIG. 6 is a partial perspective view of the embodiment of FIG. 5.

An eraser 26 is configured at the end of each eraser arm 24 and may comprise, for example, 65% of the eraser arm. In a preferred embodiment particularly illustrated in FIGS. 5 and 6, the eraser may comprise removable eraser inserts 32 which fit into eraser sockets 34 defined in eraser arms 24. Preferably, there is a friction fit between the sockets and the inserts. This embodiment may be preferred in that the eraser inserts 32 may be changed out with new inserts.

In another preferred embodiment, the entire device 10 may be formed of an eraser material. In this embodiment eraser 26 merely constitutes the end portion of arms 24. It should be understood that any combination and configuration of materials may be utilized in the present invention.

Figure 2:
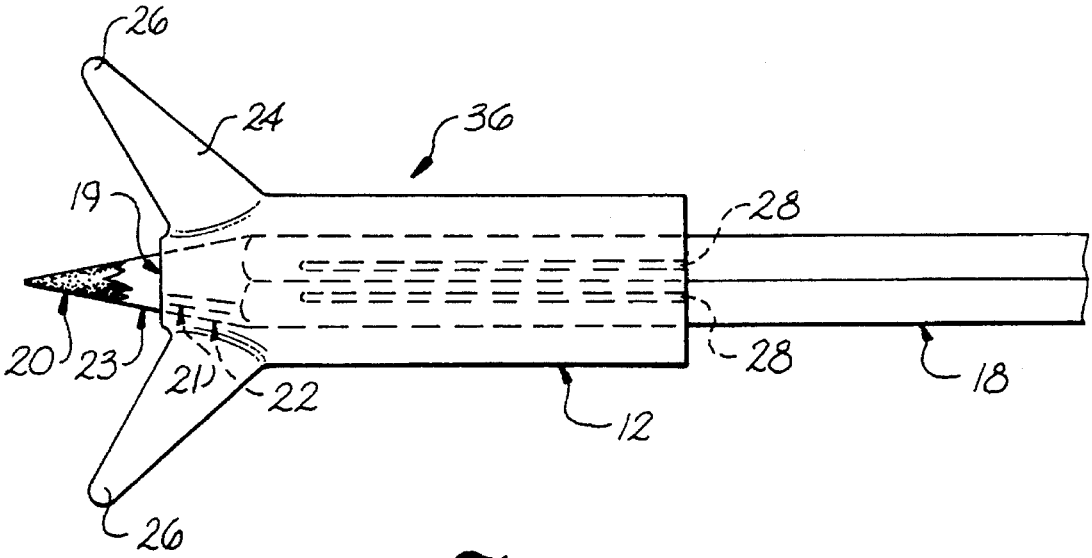
FIG. 2 is a side view of the device illustrated in FIG. 1.
Figure 3:
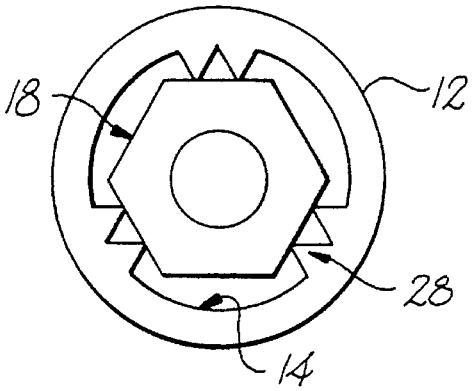
FIG. 3 is a top view of the device illustrated in FIG. 1.
Figure 4:
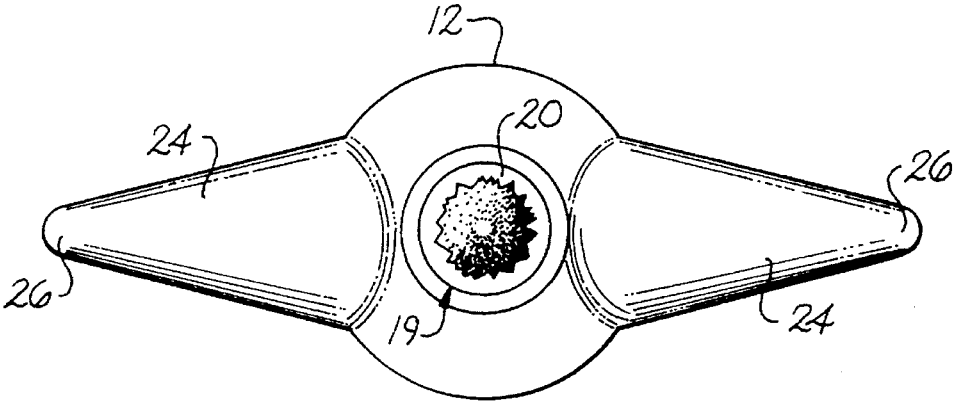
FIG. 4 is a front end view of the device illustrated in FIG. 1.

Preferably, device 10 also includes at least one internal rib 28 formed longitudinally within internal bore 14, as particularly illustrated in FIGS. 2 and 3. Ribs 28 are designed to positively grip the barrel section 18 of writing instrument 16 so as to prevent relative rotation between the writing instrument and the device. In FIG. 3, the device is illustrated with a conventional hex-shaped lead pencil. Internal ribs 28 contact flat portions of the pencil thereby preventing rotation of the pencil within finger grip section 12.

Figure 7:
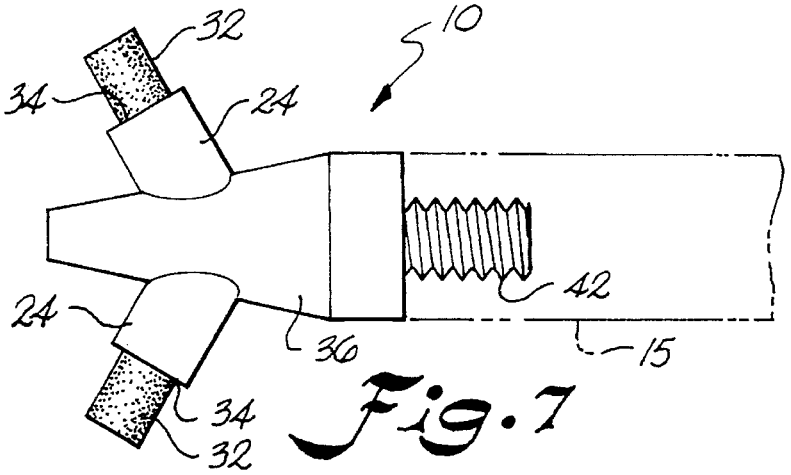
FIG. 7 is a component view of an alternative embodiment of the invention utilized with a mechanical pencil.
Figure 8:
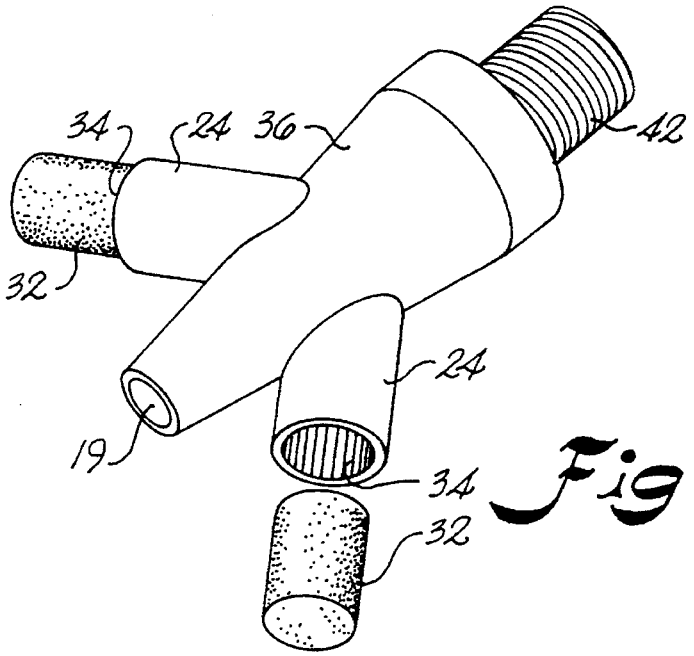
FIG. 8 is a partial perspective view of the embodiment shown in FIG. 7.

An alternative preferred embodiment of device 10 is illustrated in FIGS. 7 and 8. In this device, an eraser assembly is provided having a body portion 36 with eraser arms 24 extending radially therefrom, as discussed above. Arms 24 include eraser sockets 34 configured to receive replaceable eraser inserts 32. Body portion 36 may include a threaded extension member 42 for engagement with a mechanical pencil or pen, such as a conventional mechanical lead pencil. Any other conventional mating means may also be used in this regard, such as a friction fit, shaped form fit, snap lock, etc. This device is designed to essentially replace the conventional conical writing tips provided with standard lead pencils. Although not illustrated in the figures, it should be understood that, instead of threaded extension 42, the device 10 may comprise a threaded female section for being threaded onto a male threaded end configured on the mechanical pencil 15. FIG. 8 also discloses an aperture 19 at the tip of body member 36 capable of receiving a lead sleeve if needed.

The present device provides a relatively simple and convenient means for a person to apply an eraser to a writing surface without having to flip the writing instrument to its opposite end, and without obscuring the writing surface. In operation, an operator would grip the device 10 as generally illustrated in FIG. 1. In order to apply eraser 26 to the writing surface, the operator merely needs to lift and rotate device 10 so that one of arms 24 is adjacent the writing surface. Then, the operator merely lowers device 10 rearward in order to bring eraser 26 in contact with the writing surface. Once the erasure is complete, the operator merely turns the device in either direction so that the writing tip 20 of the instrument can be applied to the writing surface without interference from arms 24.

It will be apparent to those skilled in the art that various modifications and variations can be made in the present invention without departing from the scope or spirit of the invention. Features illustrated or described as part of one embodiment can be used on another embodiment to yield still a further embodiment. It is intended that the present invention cover such modifications and variations as come within the scope of the appended claims.

What is claimed is:

1. An eraser device for use with a writing instrument, said device comprising:

a front end;

an elongated essentially cylindrical finger grip section, said finger grip section comprising an internal bore for receipt of a writing instrument therethrough;

an internal conical bore section aligned with said finger grip section internal bore, said conical bore section tapered towards said front end of said device so as to contact at least a portion of a conical writing tip of a writing instrument inserted through said device so that the writing tip extends from said front end of said device;

at least two eraser arms extending radially opposite each other outward from said finger grip section and angled forward towards said front end, said eraser arms having a radially outward end; and an eraser configured at said radially outward ends of said eraser arm, wherein when said device is configured with a writing instrument, an operator can use said eraser by tilting and rotating said finger grip section to bring said eraser arm and eraser into contact with a writing surface.

2. The eraser device as in claim 1, further comprising at least one internal rib formed in said finger grip section internal bore, said rib configured to non-rotatably lock a writing instrument within said finger grip section.

3. The eraser device as in claim 1, wherein said finger grip section further comprises a textured outer circumferential surface.

4. The eraser device as in claim 1, wherein said eraser is formed integral with said eraser arm.

5. The eraser device as in claim 1, wherein said eraser comprises a removable insert fitted into said eraser arm.

6. The eraser device as in claim 1, wherein said device is configured to be removable from a writing instrument.

7. The eraser device as in claim 1, wherein said device is configured to be non-removably attached to a writing instrument.

8. An eraser assembly configured for use at the writing end of a writing instrument, said assembly comprising a front end and a body portion with a bore defined therethrough through which the writing end of the writing instrument can protrude; an engaging device for configuring said body portion to the writing end of a writing instrument; at least two eraser arms extending radially opposite each other outward from said body and angled towards said front end of said body, said eraser arms having radially outward ends; and an eraser at said radially outward ends of said eraser arms.

9. The eraser assembly as in claim 8, said body portion further comprises an elongated finger grip section aligned therewith, said assembly being slidable onto a writing instrument.

10. The eraser assembly as in claim 9, wherein said bore further defines a frustoconical portion through said front end of said body, said frustoconical portion mateable with a conical surface of a writing instrument tip.

11. The eraser assembly as in claim 8, wherein said assembly is configured for use with a mechanical writing instrument, said engaging device comprising a threaded extension member for threadedly engaging with the mechanical writing instrument.

12. The eraser assembly as in claim 11, wherein said eraser comprises removable eraser inserts fitted into said eraser arm.

13. The eraser assembly as in claim 8, wherein said eraser is formed integral with said eraser arm.

14. The eraser assembly as in claim 8, wherein said engaging device non-rotatably attaches said body portion to a writing instrument.

* * * * *